United States Patent [19]

Harris

[11] 3,971,880

[45] July 27, 1976

[54] PHASE STABLE TRANSMISSION CABLE

[75] Inventor: Dewey F. Harris, Monument, Colo.

[73] Assignee: Kaman Sciences Corporation, Colorado Springs, Colo.

[22] Filed: Aug. 4, 1975

[21] Appl. No.: 601,511

Related U.S. Application Data

[62] Division of Ser. No. 515,307, Oct. 16, 1974, Pat. No. 3,909,555.

[52] U.S. Cl. ..... 174/36; 174/102 P; 174/106 R; 174/126 CP

[51] Int. Cl.[2] ..... H01B 7/18

[58] Field of Search ..... 174/36, 102 R, 102 P, 174/102 A, 106 R, 118, 126 CP, 128 R

[56] References Cited

UNITED STATES PATENTS

| | | | |
|---|---|---|---|
| 2,312,506 | 3/1943 | Tomlinson et al. | 174/118 X |
| 3,005,038 | 10/1961 | Donohue | 174/118 X |
| 3,305,820 | 2/1967 | Lennox | 174/106 R X |
| 3,715,453 | 2/1973 | Aupoix et al. | 174/106 R |

*Primary Examiner*—Arthur T. Grimley
*Attorney, Agent, or Firm*—Max L. Wymore

[57] ABSTRACT

A cable for high frequency use in an environment with high and varying thermal changes whereby the thermal expansion of the cable is controlled by having a highly electrically conductive metal bonded to a metal of low coefficient of thermal expansion relative to the high electrically conductive metal. This is accomplished by providing a thin layer of highly electrically conductive metal over an inner core of a metal of low coefficient of thermal expansion. The cable can also utilize a similar bonded metal configuration for an outer concentric conductive sheath having a mineral dielectric between conductors that also has a low coefficient of thermal expansion.

1 Claim, 5 Drawing Figures

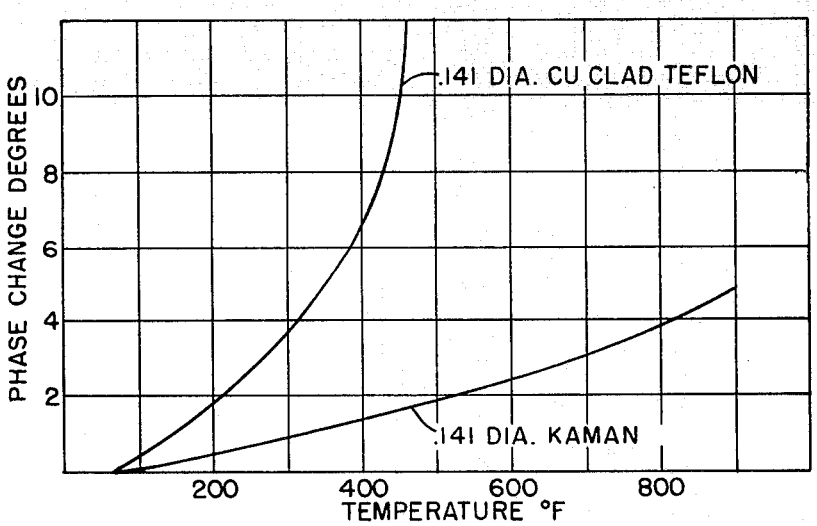
FIG. 1
FIG. 2
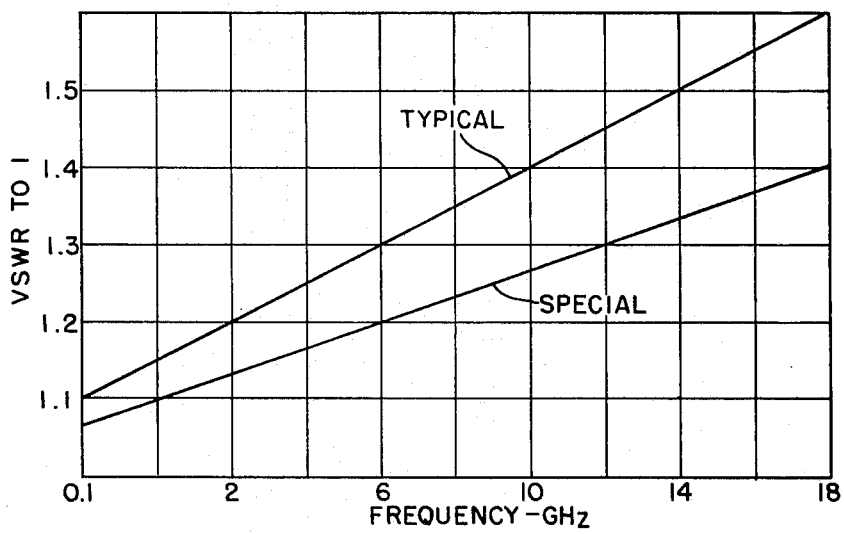
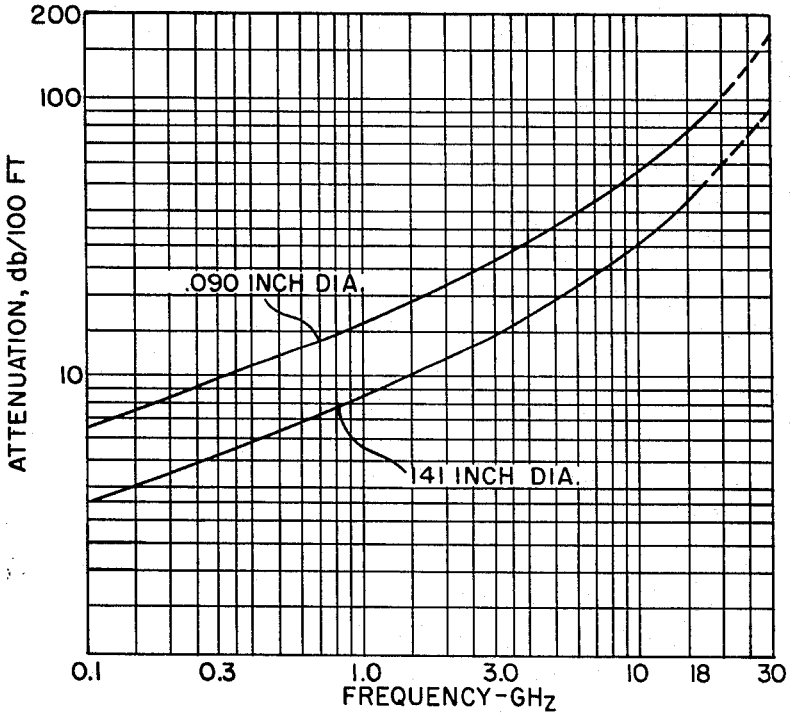
FIG. 3

PHASE STABLE TRANSMISSION CABLE

This is a division of application Ser. No. 515,307, filed Oct. 16, 1974, now U.S. Pat. No. 3,909,555.

This invention relates to an improved coaxial cable capable of use under high and varying temperature conditions and of transmitting a wide band of frequencies with minimum loss.

The exacting requirements of modern control equipment, particularly space age requirements, demands the use of a radio frequency coaxial cable that exhibits a minimum change in electrical length due to installation bends in the cable and moderate to severe temperature changes. Further the cable should not change after installation due to the effects of aging or cold flow of materials. An object of this invention is to provide an improved coaxial cable which will fulfill these requirements.

conventional coaxial cable utilizing thermoplastics as a dielectric material exhibit prohibitive electrical length changes due to cold flow of the dielectric material and changes with temperature due to the high coefficient of expansion of the dielectric material. Aging of the dielectric material changing its electric properties can also affect the electrical length of the cable.

Improved electrical length stability is achieved in the prior art by the use of a mineral dielectric material which characteristically has a low coefficient of thermal expansion, such as silica, magnesia or alumina. Such cables use a central conductor about which the dielectric is extruded. The dielectric coated central conductor is then threaded into a metal tube as the outer conductor which is drawn down to a lesser diameter to compact the dielectric material to the desired degree.

A further object of my invention is to provide an improved cable having conductors of novel construction which when used in conjunction with a mineral insulator provides a coaxial cable having a high electrical length stability.

A still further objective is to provide such improved cable which is capable of being cycled through wide temperature ranges up to about 850°F without significant change in its electrical or physical properties. A still further object is to provide an improved electrical stable cable which is economical to produce.

These and other objects of my invention will be apparent from the following description and the appended claims, reference being had to the accompanying drawings in which:

FIG. 1 is a graphical representation of the phase change of a signal in passing through a length of prior art and my cable versus temperature;

FIG. 2 is a graphical representation of the standing wave ratio versus frequency of cable according to the invention;

FIG. 3 is a graphical representation of the attenuation versus frequency of two sizes of cable according to the invention;

Figure 4:
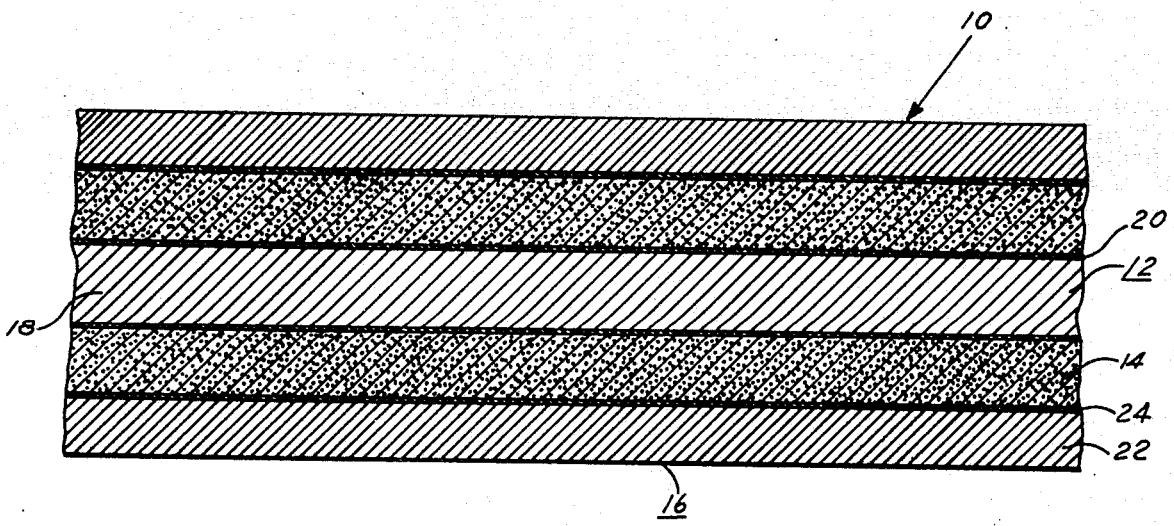
FIG. 4 is a longitudinal sectional view of a cable according to this invention; and, FIG. 5 is a cross-sectional view along lines 5—5 of FIG. 4.
Figure 5:
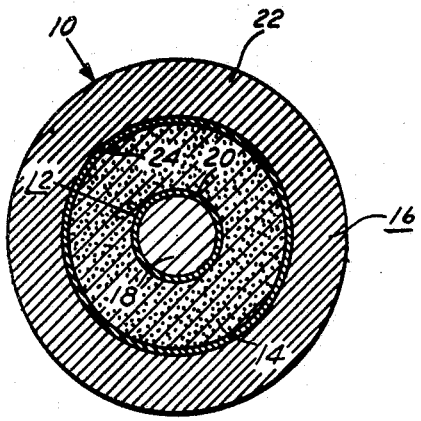

In FIGS. 4 and 5 there is shown cable 10 comprising a center conductor 12 surrounded by a layer of insulating material 14 encased in a metal sheath 16 of a ductile metal capable of standing high temperatures. These conductors are usually of copper or silver and the outer sheath may be overcoated with stainless steel for protection purposes. These conductors suffer excessive electrical length changes due to the high coefficient of thermal expansion of the metals used. According to the present invention the center conductor 12 is comprised of a center core 18 of a metal alloy or metal having a low coefficient of thermal expansion having a relatively thin outer layer 20 bonded thereto of a metal having low electrical resistance such as copper or silver. The metal alloy may be a low thermal expansion alloy of iron-cobalt-nickel composition such as those sold under the trademark of Kovar, Nilvar, Rodar and the like. The bond is preferably a metallurgical bond or one sufficient that the resulting thermal expansion characteristics of the composite material be that of the parent low-expansion metal or alloy. Pure metals having low thermal expansion are molybdenum, tungsten or the like. Similarly, the sheath 16 is comprised of an outer shell 22 of a metal or metal alloy having a low coefficient of thermal expansion with a relatively thin inner layer 24 bonded thereto of a low electrical resistance metal such as copper or silver. Again the inner layer 24 is preferably bonded to the outer shell 22 by a metallurgical bond or one sufficient to insure that the thermal coefficient of expansion of the composite sheath 16 is that of the low expansion metal or alloy.

THe use of low expansion alloys or metals by themselves would not be satisfactory due to their high electrical resistivity, however, since in a coaxial cable operating at high frequencies, the energy is transmitted on the skin of the conductors, the provision of the low expansion alloys or metals with a skin of low electrical resistance allows the efficient transmission of electrical signals thereon, while avoiding excessive changes in thermal expansion of the conductors such that the electrical and physical properties thereof remain substantially unchanged.

Referring now to FIG. 1, two 0.141 inch diameter cables are compared. One is that of a conventional copper-clad Teflon cable while curve B is representative of a cable according to this invention. Both cables were 36 inches long, with 24 inches exposed to the temperature zone. The Teflon cable was thermally conditioned to eliminate the high initial phase changes with temperatures that are present with this type of cable. The measurements of the data presented in FIG. 1 were made at a frequency of 1 GHz utilizing a vector voltmeter.

Referring to FIG. 2, the curve A represents the standing wave ratio of the typical cable constructed according to this invention and curve B represents the ratio for specially constructed cables. The typical cable assembly including hermetically sealed connectors has a VSWR of less than 1.6 to 1 to 18 GHz. Special assemblies have been fabricated using the teaching of this invention with a VSWR of less than 1.4 to 1 to 18 GHz. Measurements utilize a swept-frequency technique and the assemblies according to the present invention are free of resonances up to 18 GHz.

The dielectric constant of the cable according to the present invention is 1.6 with a corresponding low loss tangent. Losses are therefore less than those of comparably sized Teflon cable. Losses of 0.090 and 0.141 inch diameter cable according to the invention as shown in FIG. 3.

While there have been described what at present are considered to be the preferred embodiments of this invention, it will be obvious to those skilled in the art that various changes and modifications may be made therein without departing from the invention. It is aimed, therefore, in the appended claims to cover all such changes and modifications which fall within the true spirit and scope of the invention.

What is claimed is:

1. A high temperature electrical length stable radio frequency cable comprising a center conductor, a spaced concentric conductive sheath and a dielectric insulating medium between said sheath and the center conductor wherein the sheath comprises a hollow tubular member of a metal or metal alloy of low coefficient of thermal expansion with a relatively thin layer of low electrical resistivity metal bonded to the inside thereof and wherein the dielectric material is selected from the group consisting of silica, magnesia and alumina.

* * * * *